US008860958B2

(12) United States Patent
Ito et al.

(10) Patent No.: US 8,860,958 B2
(45) Date of Patent: Oct. 14, 2014

(54) SHEET CONVEYER DEVICES, IMAGE READING APPARATUSES, AND IMAGE FORMING APPARATUSES

(75) Inventors: Tetsuo Ito, Aichi (JP); Kazutoshi Kuse, Aichi (JP); Masanori Hamaguchi, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 97 days.

(21) Appl. No.: 13/433,437

(22) Filed: Mar. 29, 2012

(65) Prior Publication Data

US 2012/0307274 A1 Dec. 6, 2012

(30) Foreign Application Priority Data

May 31, 2011 (JP) ..... 2011-121290

(51) Int. Cl.

| | |
|---|---|
| ***G06K 15/00*** | (2006.01) |
| ***G06K 15/10*** | (2006.01) |
| ***G06K 1/00*** | (2006.01) |
| ***H04N 1/04*** | (2006.01) |
| ***B65H 3/06*** | (2006.01) |
| ***B65H 3/56*** | (2006.01) |

(52) U.S. Cl.

CPC ..... *B65H 3/0684* (2013.01); *B65H 2403/72* (2013.01); *B65H 2801/39* (2013.01); *B65H 2404/1521* (2013.01); *B65H 2301/3122* (2013.01); *B65H 2301/4222* (2013.01); *B65H 3/56* (2013.01)

USPC ..... 358/1.12; 358/474; 358/498; 358/496; 358/1.5; 399/328; 399/92; 399/335

(58) Field of Classification Search

None

See application file for complete search history.

(56) References Cited

U.S. PATENT DOCUMENTS

| | | | | |
|---|---|---|---|---|
| 5,090,827 | A * | 2/1992 | Hirano et al. | 400/185 |
| 5,497,986 | A | 3/1996 | Kudo | |
| 7,571,909 | B2 * | 8/2009 | Saeki et al. | 271/292 |
| 8,382,095 | B2 | 2/2013 | Osanai et al. | |
| 2005/0035524 | A1 * | 2/2005 | Fukumura et al. | 271/4.1 |

(Continued)

FOREIGN PATENT DOCUMENTS

| | | | |
|---|---|---|---|
| CN | 101823637 | A | 9/2010 |
| JP | 2000-177871 | A | 6/2000 |
| JP | 2001-348130 | | 12/2001 |
| JP | 2002-029639 | | 1/2002 |

OTHER PUBLICATIONS

First Office Action issued in corresponding Chinese Patent Application No. 201210092223.6 mailed Jul. 3, 2014.

*Primary Examiner* — Satwant Singh

(74) *Attorney, Agent, or Firm* — Banner & Witcoff, Ltd.

(57) ABSTRACT

A sheet conveyer device, including a roller to convey a sheet by rotating in a normal direction and a holder rotatably arranged on a roller shaft, is provided. The holder includes a roller gear system arranged on the roller shaft and having a roller driving gear to drive the roller, a shutter rotatably arranged on a shutter shaft to restrict access of the sheet to the roller, a shutter gear system to connect a path between the roller gear system and the shutter, a one-way clutch to disconnect the path between the roller gear system and the shutter when the roller rotates in the normal direction, and a torque limiter to allow the roller to rotate in a reverse direction. The holder rotates about the roller shaft in the same reverse direction as the roller when the roller rotates in the reverse direction.

9 Claims, 8 Drawing Sheets

(56) References Cited

U.S. PATENT DOCUMENTS

2005/0087920 A1* 4/2005 Takamatsu ..... 271/10.01
2007/0003344 A1* 1/2007 Lee et al. ..... 399/374
2009/0168093 A1* 7/2009 Kim ..... 358/1.15
2010/0225977 A1* 9/2010 Osanai et al. ..... 358/474
2012/0013068 A1* 1/2012 Kayama ..... 271/264
2013/0078016 A1* 3/2013 Koyama et al. ..... 399/328

* cited by examiner

SHEET CONVEYER DEVICES, IMAGE READING APPARATUSES, AND IMAGE FORMING APPARATUSES

CROSS REFERENCE TO RELATED APPLICATION

This application claims priority from Japanese Patent Application No. 2011-121290, filed on May 31, 2011, the entire subject matter of which is incorporated herein by reference.

BACKGROUND

1. Technical Field

An aspect of the disclosure relates to a sheet conveyer device, an image reading apparatus, and an image forming apparatus.

2. Related Art

An image reading apparatus, such as an image scanner, is often equipped with a sheet conveyer device called ADF (auto document feeder), which picks up a plurality of sheets one-by-one and conveys the picked-up sheets to a readable position. The sheet conveyer device may be equipped with a shutter, which restricts the sheets from being drawn inside the ADF when the sheets are not needed. The shutter may be coupled to a driving shaft of a roller via a one-way clutch, and when the driving shaft should not be rotated, load from a driving source may be transmitted to the shutter via the one-way cutch instead of the roller. Thus, when the driving shaft is maintained motionless, the shutter receiving the load may restrict entry of the sheets. When the driving shaft is rotated by the driving source, the shutter may be released from the load and uplifted by a front end of the sheet being conveyed. As the shutter is uplifted and opens a path to the sheet, the sheet may be allowed to enter inside.

SUMMARY

With the shutter, however, when the sheet is jammed in the ADF, and when a user attempts to pull the jammed sheet out of the ADF, the roller being in contact with the sheet may rotate in a reverse direction. When the roller rotates in the reverse direction, the reverse rotation may be transmitted to the shutter via the driving shaft, and the shutter may be urged to the sheet being pulled to hold the sheet thereat. Thus, the shutter may interrupt the sheet from being taken out of the ADF.

An aspect of the disclosure is advantageous in that a sheet conveyer device, an image reading apparatus, and an image forming apparatus, which can prevent the jammed sheet from being interfered with by the shutter when the user attempts to pull the sheet out of the device, are provided.

According to an aspect of the disclosure, a sheet conveyer device, which is configured to convey a sheet in a conveyer path along a conveying direction, is provided. The sheet conveyer device includes a roller, which is rotatably arranged on a roller shaft to rotate about the roller shaft and is configured to convey the sheet by rotating in a normal direction, and a holder, which is rotatably arranged on the roller shaft to rotate about the roller shaft. The holder includes a roller gear system, which is arranged on the roller shaft and has a roller driving gear to drive the roller, a shutter, which is rotatably arranged on a shutter shaft and is configured to restrict access of the sheet to the roller, the shutter shaft being arranged in an upstream position with respect to the roller shaft along the conveying direction, a shutter gear system, which is arranged to be movable in cooperation with the shutter shaft and is configured to connect a path between the roller gear system and the shutter, a one-way clutch, which is arranged in the roller gear system or the shutter gear system and is configured to disconnect the path between the roller gear system and the shutter when the roller rotates in the normal direction, and a torque limiter, which is arranged in the roller gear system or the shutter gear system and is configured to allow the roller to rotate in a reverse direction, the reverse direction being an opposite direction from the normal direction. The holder is configured to rotate about the roller shaft in the same reverse direction as the roller when the roller rotates in the reverse direction.

According to another aspect of the disclosure, an image reading apparatus is provided. The image reading apparatus includes a sheet conveyer device, which is configured to convey a sheet in a conveyer path along a conveying direction, and an image reading unit, which is configured to read an image appearing on the sheet being conveyed by the sheet conveyer device. The sheet conveyer device includes a roller, which is rotatably arranged on a roller shaft to rotate about the roller shaft and is configured to convey the sheet by rotating in a normal direction, and a holder, which is rotatably arranged on the roller shaft to rotate about the roller shaft. The holder includes a roller gear system, which is arranged on the roller shaft and has a roller driving gear to drive the roller, a shutter, which is rotatably arranged on a shutter shaft and is configured to restrict access of the sheet to the roller, the shutter shaft being arranged in an upstream position with respect to the roller shaft along the conveying direction, a shutter gear system, which is arranged to be movable in cooperation with the shutter shaft and is configured to connect a path between the roller gear system and the shutter, a one-way clutch, which is arranged in the roller gear system or the shutter gear system and is configured to disconnect the path between the roller gear system and the shutter when the roller rotates in the normal direction, and a torque limiter, which is arranged in the roller gear system or the shutter gear system and is configured to allow the roller to rotate in a reverse direction, the reverse direction being an opposite direction from the normal direction. The holder is configured to rotate about the roller shaft in the same reverse direction as the roller when the roller rotates in the reverse direction.

According to another aspect of the disclosure, an image forming apparatus is provided. The image forming apparatus includes a sheet conveyer device, which is configured to convey a sheet in a conveyer path along a conveying direction, an image reading unit, which is configured to read an image appearing on the sheet being conveyed by the sheet conveyer device, and an image forming unit, which is configured to form an image on a recording medium according to the image read by the image reading unit. The sheet conveyer device includes a roller, which is rotatably arranged on a roller shaft to rotate about the roller shaft and is configured to convey the sheet by rotating in a normal direction, and a holder, which is rotatably arranged on the roller shaft to rotate about the roller shaft. The holder includes a roller gear system, which is arranged on the roller shaft and has a roller driving gear to drive the roller, a shutter, which is rotatably arranged on a shutter shaft and is configured to restrict access of the sheet to the roller, the shutter shaft being arranged in an upstream position with respect to the roller shaft along the conveying direction, a shutter gear system, which is arranged to be movable in cooperation with the shutter shaft and is configured to connect a path between the roller gear system and the shutter, a one-way clutch, which is arranged in the roller gear system or the shutter gear system and is configured to disconnect the path between the roller gear system and the shutter when the roller rotates in the normal direction, and a torque limiter, which is arranged in the roller gear system or the shutter gear system and is configured to allow the roller to rotate in a reverse direction, the reverse direction being an opposite direction from the normal direction. The holder is configured to rotate about the roller shaft in the same reverse direction as the roller when the roller rotates in the reverse direction.

BRIEF DESCRIPTION OF THE ACCOMPANYING DRAWINGS

Figure 8:
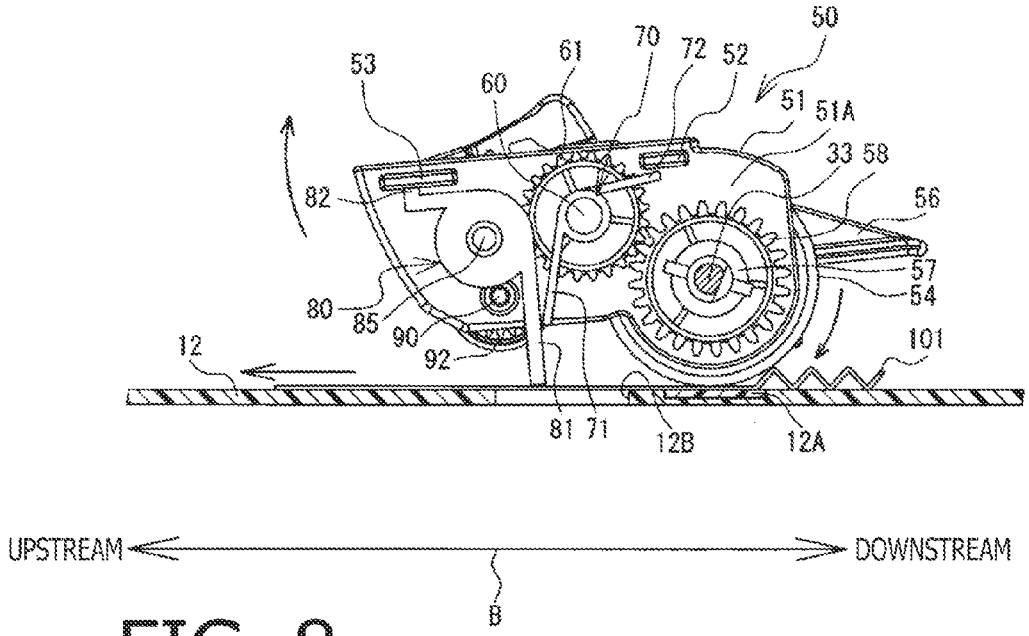

FIG. 8 is a side view of the feeder unit 50 in the MFP 1 with a separator roller 54 being rotated in a reverse direction and when the original sheet 101 is pulled backward.

Figure 9:
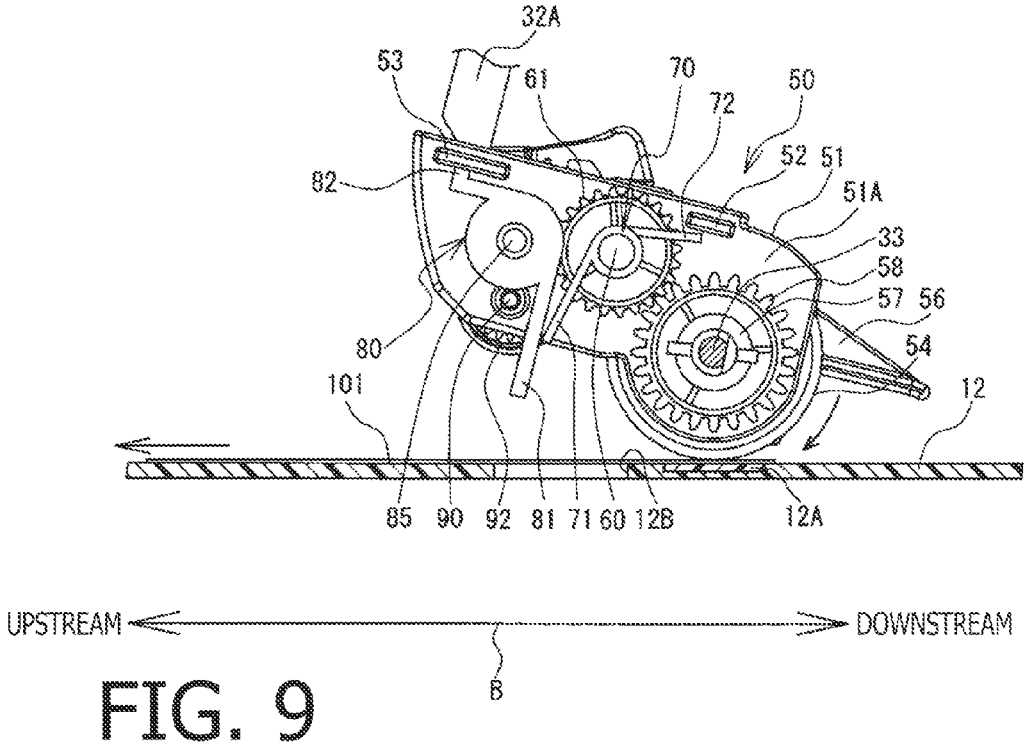

FIG. 9 is a side view of the feeder unit 50 with a holder 51 being uplifted to a top dead center in the MFP 1.

Figure 10:
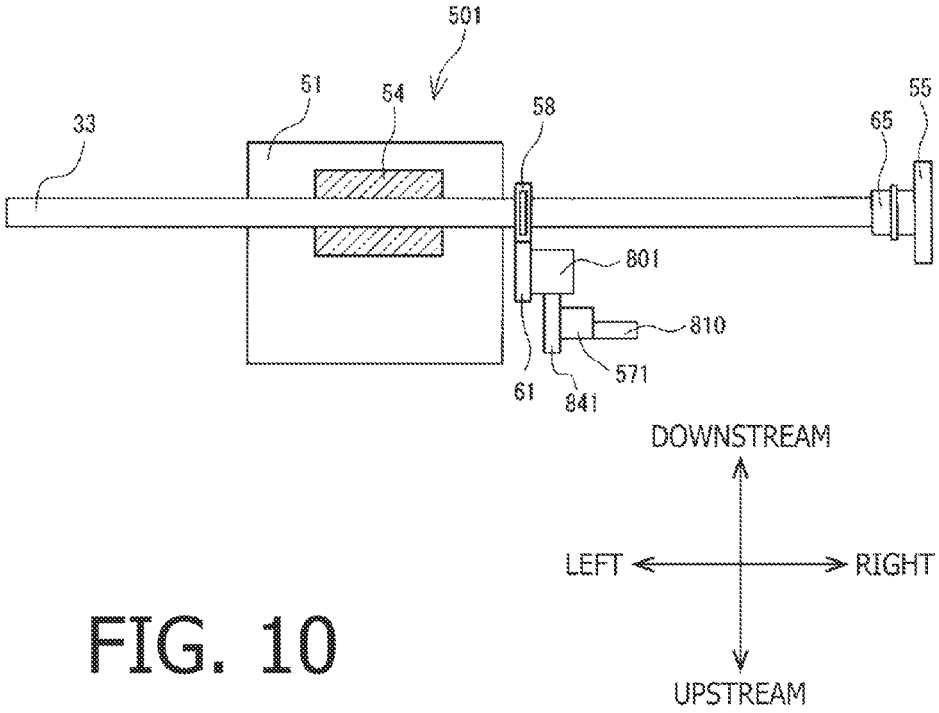

FIG. 10 is a top plane view of a part of a feeder unit 501 in the MFP 1.

Figure 11:
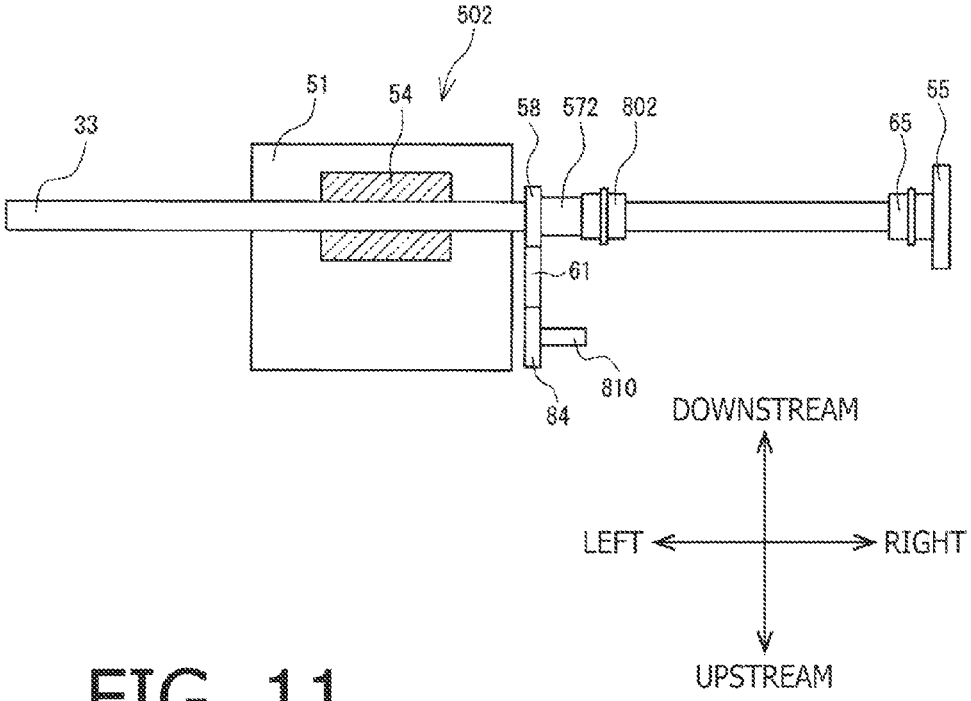

FIG. 11 is a top plane view of a part of a feeder unit 502 in the MFP 1.

DETAILED DESCRIPTION

Hereinafter, an ADF 10, an image reading apparatus 20, and an MFP 1 being embodiments according to the disclosure will be described with reference to the accompanying drawings.

Figure 1:
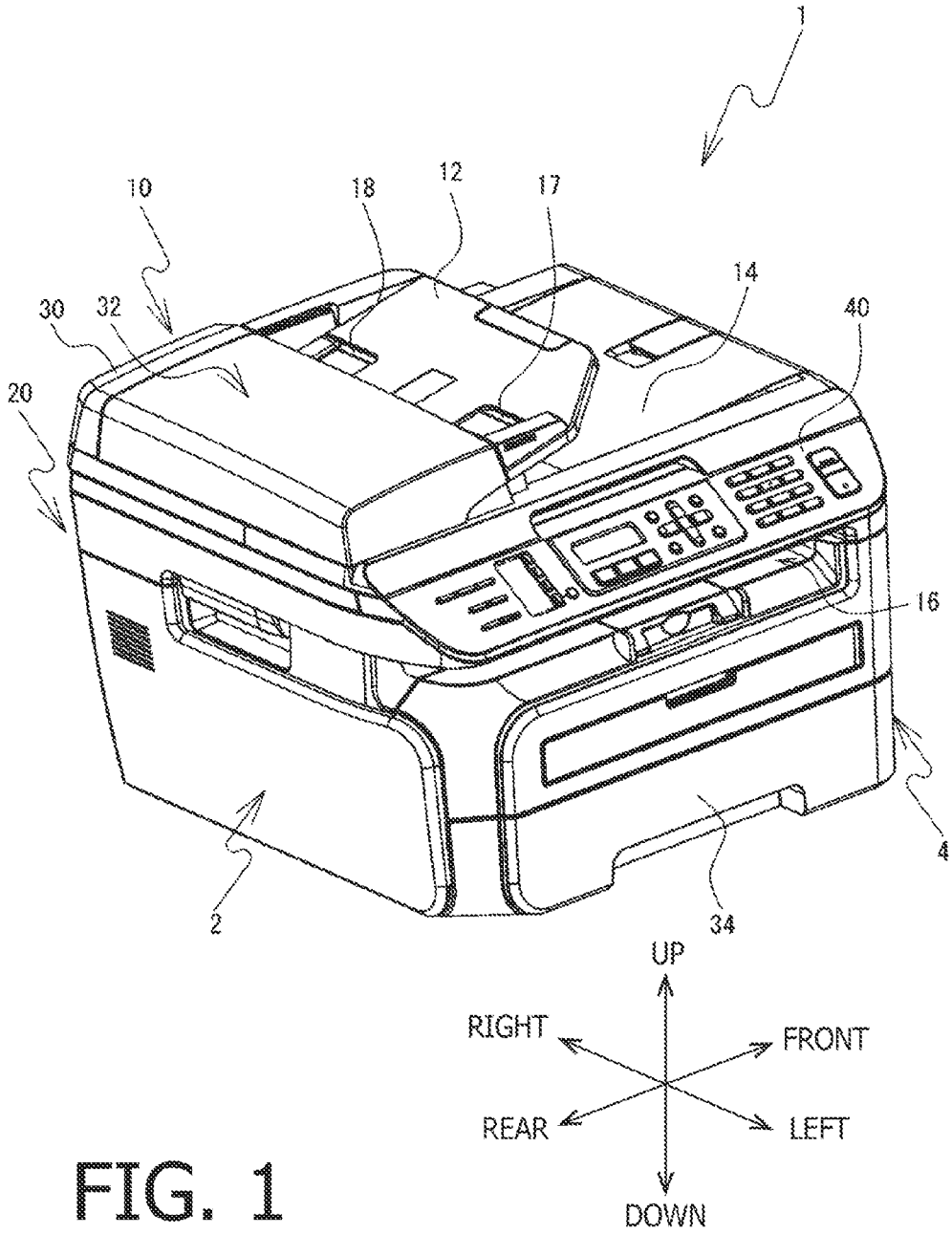
FIG. 1 is a perspective view of an MFP 1 according to an embodiment of the disclosure.
Figure 2:
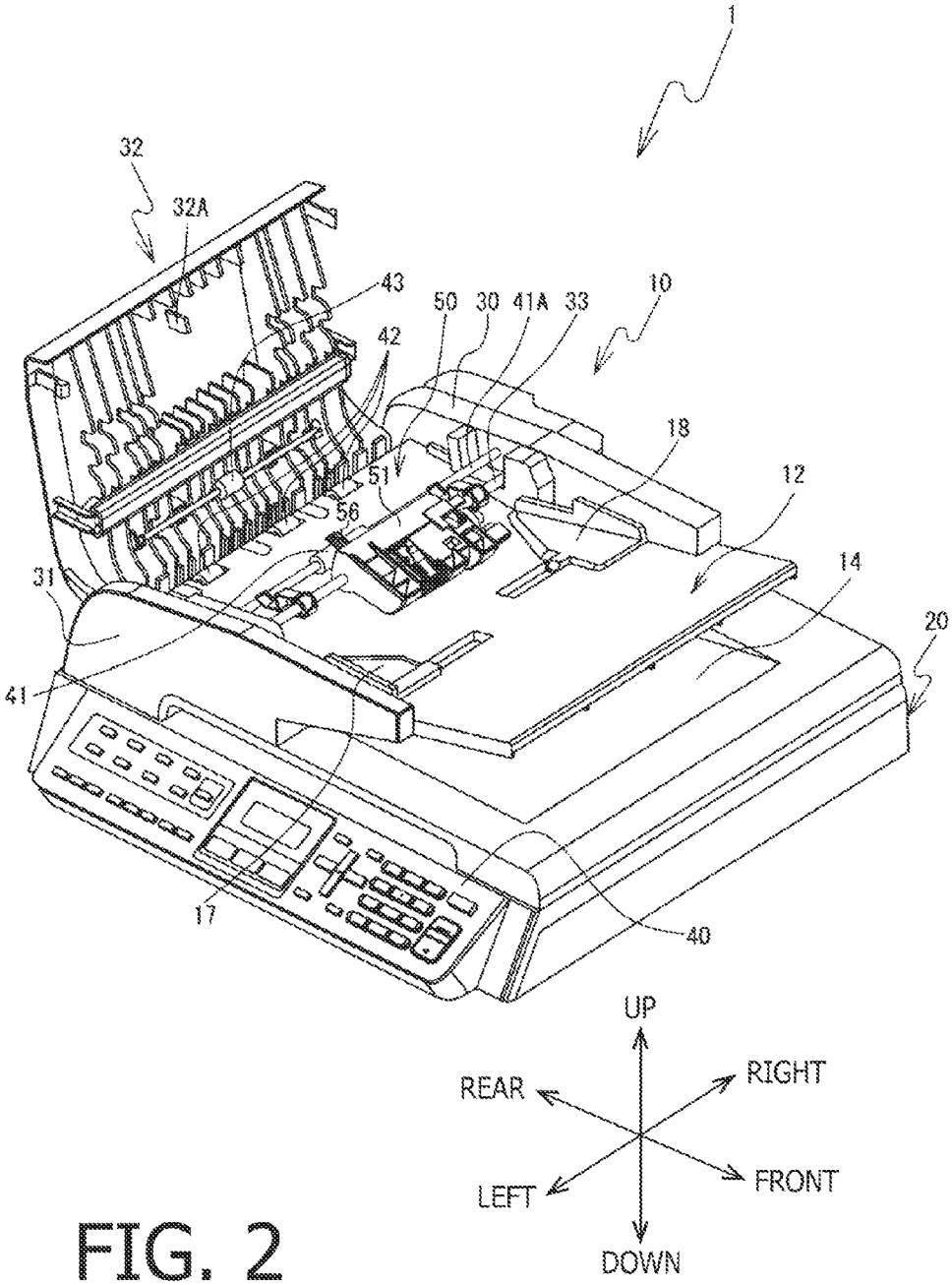
FIG. 2 is a perspective view of the MFP 1 with a top cover 32 of an ADF 10 being open.
Figure 3:
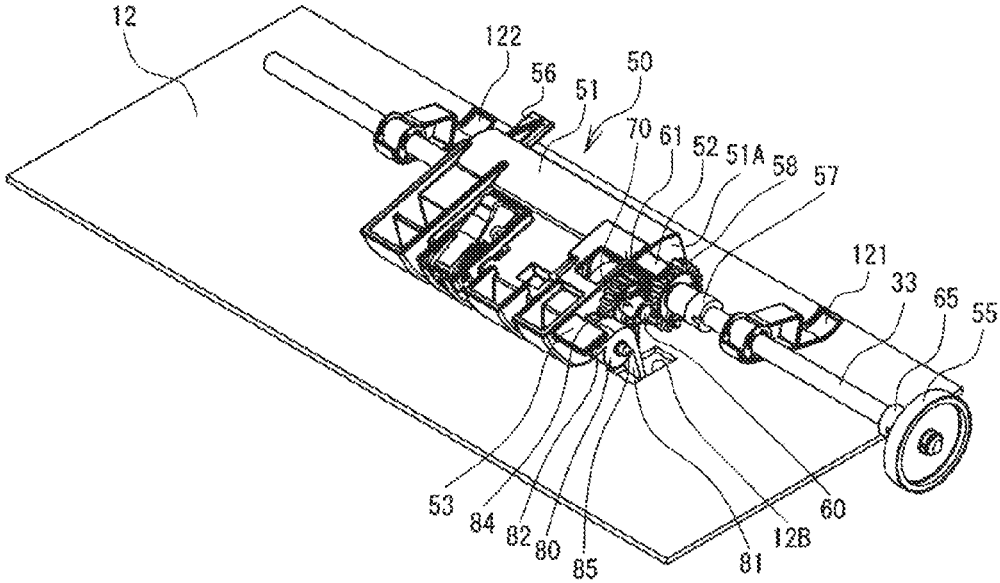
FIG. 3 is a perspective view of a feeder unit 50 in the MFP 1.
Figure 3:
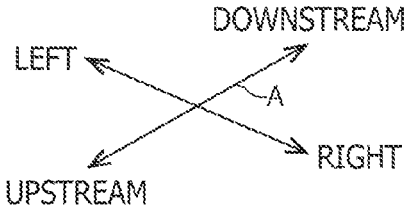

In the embodiments described below, directions concerning the ADF 10, the image reading apparatus 20, and the MFP 1 will be referred to based on the orientation indicated by arrows shown in each drawing. For example, in FIG. 1, a viewer's upper-right side, a lower-left side, an upper-left side, a lower-right side in FIG. 1 will be referred to as front, rear, right, and left for the MFP 1 respectively. In FIG. 2, a viewer's lower-right side, an upper-left side, an upper-right side, a lower-left side will be referred to as front, rear, right, and left for the ADF 10 respectively. In FIG. 3, a viewer's lower-left side, an upper-right side, a lower-right side, an upper-left side will be referred to as upstream (front), downstream (rear), right, and left for a feeder unit 50 respectively. Further, a direction from rear toward front along a direction A (see FIG. 3) will be referred to as a sheet conveying direction, in which an original sheet 101 to be read in the image reading apparatus 20 is conveyed. In FIGS. 3-9, meanwhile, a direction from left to right along a direction B (see FIGS. 5-9) is the sheet conveying direction. A backward side and a forward side along the sheet conveying direction will be referred to as an upstream side and a downstream side respectively. Furthermore, in FIGS. 5-9, a counterclockwise rotating direction will be referred to as a normal direction, and a clockwise rotating direction will be referred to as a reverse direction. The front-rear direction of the MFP 1 may also be referred to as a direction of depth. The right-left direction of the MFP 1 may also be referred to as a widthwise direction. The up-down direction in the drawings corresponds to a vertical direction of the MFP 1.

An overall configuration of the MFP 1 will be described with reference to FIG. 1. The MFP 1 is a multifunction peripheral machine, which provides a plurality of functions including a telecommunication function, a printing function, a scanning function, a copying function, and a facsimile transmission/receiving function. The MFP 1 has a printer unit 4 inside a main body 2, which is in a lower section, and an image reading apparatus 20 to read an original image appearing on an original sheet 101 in an upper section with respect to the main body 2. On a left face of the image reading apparatus 20, an operation panel 40 is provided. The operation panel 40 is touched and operated by a user to enter instructions and information concerning operations in the MFP 1.

The image reading apparatus 20 will be described below. As shown in FIG. 1, the image reading apparatus 20 includes the ADF 10. The ADF 10 is openable and closable with respect to the image reading apparatus 20. When the ADF 10 is open, a contact glass (not shown) arranged on top of the image reading apparatus 20 is exposed. Whilst the user may or may not use the ADF 10 in order to scan the original image on the original sheet, if the user chooses not to use the ADF 10, the user opens the ADF 10 and places the original sheet in a predetermined position on the contact glass. When the original sheet is set on the contact glass, the user places the ADF 10 in a closed position (see FIG. 1), and manipulates the image reading apparatus 20 via the operation panel 40. In a lower position with respect to the contact glass, an image sensor (not shown) is provided, and when the user's instruction for reading the original sheet is entered, the image sensor is moved along a slider shaft (not shown) and scans the original sheet placed on the contact glass to read the image appearing on the original sheet. The image read by the image sensor is stored in a memory device (not shown).

The printer unit 4 is equipped with an image forming unit (not shown), which includes a known exposure device, a developer device, and a fixing device. The printer unit 4 further has a sheet-feed tray 34, in which recording sheets of paper being recording media are stored, and transfers an image formed in a developer agent on the recording sheet to print the image whilst the recording sheet is carried. The main body 2 of the MFP 1 is formed to have a discharge unit 16 in a lower position with respect to a discharge tray 14 in the ADF 10. In the discharge unit 16, the recording sheet with the printed image is caught.

The ADF 10 will be described below. As shown in FIG. 1, the ADF 10 is arranged to cover the top part of the image reading apparatus 20. The ADF 10 is formed to have an original sheet tray 12, on which the original sheets to be read are set, and the discharge tray 14, in which the original sheets having been read are released. The original sheet tray 12 and the discharge tray 14 are formed in two vertically overlapping layers with the original sheet tray 12 on top of the discharge tray 14. In the original sheet tray 12, a plurality of original sheets may be placed in a stack. In the original sheet tray 12, a pair of sheet guides 17, 18 is provided. The sheet guides 17, 18 are movable in a direction of sheet-width. The sheet guides 17, 18 restrict an orientation of the original sheet being placed on the original sheet tray 12.

The ADF 10 conveys the original sheet drawn from the original sheet tray 12 along a U-shaped conveyer path (not shown) to read the original image appearing thereon and discharges the original sheet having been read in the discharge tray 14. The ADF 10 has an image reader unit (not shown) in a position along the conveyer path, and the original sheet passing by the image reader unit can be read by the image sensor.

As shown in FIG. 2, the ADF 10 has support frames 30, 31 and a top cover 32. The support frame 30 is arranged on a right side with respect to the original sheet tray 12 in an upright posture and extends along the sheet conveying direction. The support frame 31 is arranged on a left side with respect to the original sheet tray 12 in an upright posture and extends along the sheet conveying direction. The top cover 32 is rotatably supported by a shaft (not shown), which extends in between rear ends of the support frames 30, 31. Therefore, the top cover 32 is rotatably movable between a closed position (see FIG. 1) and an open position (see FIG. 2).

As shown in FIG. 2, when the top cover 32 is open, internal structure of the ADF 10 is exposed. In a midst position between the support frames 30, 31, a rotation shaft 33 extending in a direction orthogonal to the sheet conveying direction is rotatably supported. In a vicinity of a right-side end of the rotation shaft 33, a driving gear 55 (see FIG. 3) is arranged. The driving gear 55 is driven by a motor (not shown) and rotates the rotation shaft 33. In an axial central position of the rotation shaft 33, a feeder unit 50 is rotatably arranged. The feeder unit 50 (see FIG. 5) picks up an original sheet 101 (see FIG. 6) from a stack of original sheets 100 one-by-one and conveys the picked up sheet 100 in the conveyer path separately.

In vicinities of lateral ends of the feeder unit 50, sheet pressers 121, 122 (see FIG. 3) are attached to the rotation shaft 33. The sheet pressers 121, 122 urge the original sheet 101 against a bottom of the original sheet tray 12. On a downstream side of the feeder unit 50 along the sheet conveying direction, a conveyer roller 41 (see FIG. 2) is arranged. The conveyer roller 41 rotates about a shaft 41A and conveys the original sheet 101 in the conveyer path. On a downstream side of the conveyer roller 41 along the sheet conveying direction, a main roller 42 is arranged. Further, on a downward surface (when the top cover 32 is in the closed position) of the top cover 32, a pinch roller 43 is arranged. The pinch roller 43 is arranged to face the main roller 42 when the top cover 32 is in the closed position. The main roller 42 conveys and turns the original sheet 101 along a U-shaped section in cooperation with the pinch roller 43. Thus, the original sheet 101 is carried to the discharge tray 14.

Next, the feeder unit 50 will be described in more detail below. The feeder unit 50 includes a resin holder 51 (see FIGS. 3-5). The holder 51 is rotatably arranged on the rotation shaft 33, which is supported by the support frames 30, 31 (see FIG. 2), to swing about the rotation shaft 33. The holder 51 includes an extended section 56, which extends from a position in the vicinity of the rotation shaft 33 toward the downstream side along the sheet conveying direction (se FIGS. 5 and 6). The holder 51 further includes a separator roller 54, a torque limiter 57, a roller gear 58, an idle gear 61, a shutter gear 84 (see FIG. 3), a one-way clutch 80, a spring 70, and a pickup roller 92. It is to be noted in the present embodiment that these components to be included in the holder 51 may not necessarily be arranged in positions between a right-side face 51A and a left-side face (not shown in FIG. 3) of the holder 51, but these may be arranged outside the range between the right-side face 51A and the left-side face of the holder 51, such as the torque limiter 57 being arranged on the outside the holder 51 (see FIG. 3).

Figure 5:
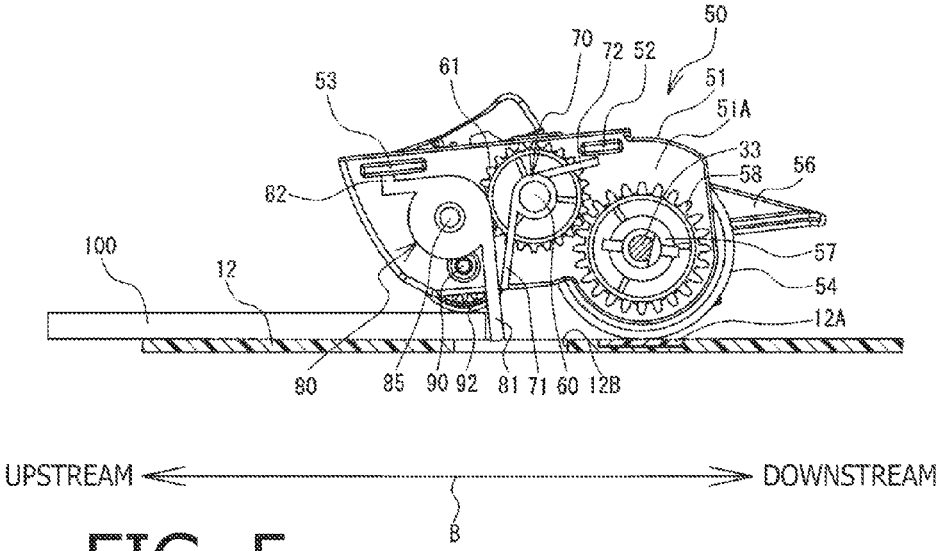
FIG. 5 is a side view of the feeder unit 50 in the MFP 1 when a motor is not in motion.
Figure 6:
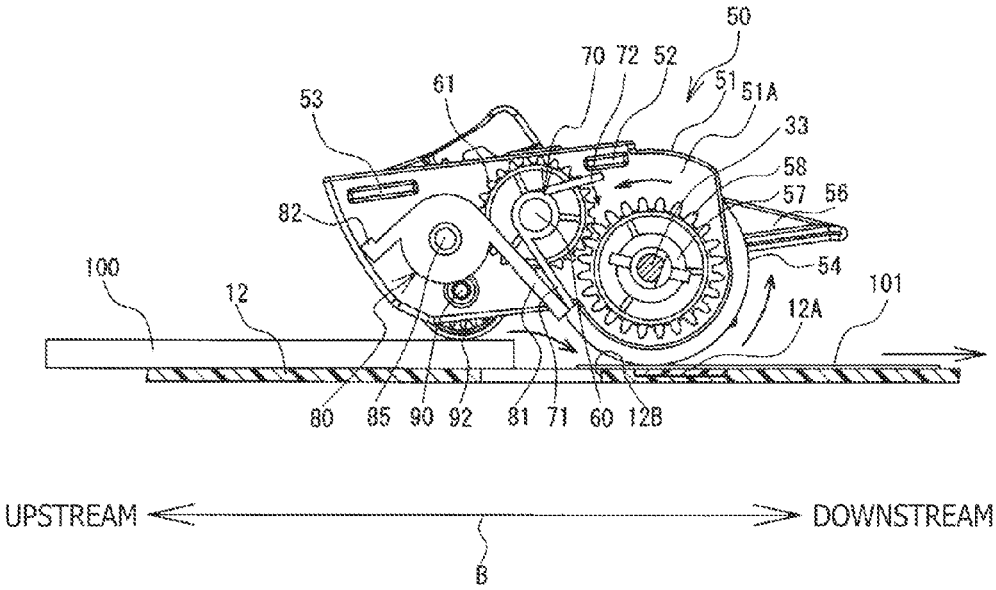
FIG. 6 is a side view of the feeder unit 50 in the MFP 1 when the motor is in motion and an original sheet 101 is fed.

Further, as shown in FIG. 5, a gear shaft 60, a shutter shaft 85, and a conveyer shaft 90 are arranged in upstream positions with respect to the rotation shaft 33 along the sheet conveying direction. The gear shaft 60 is arranged in an intermediate position between the rotation shaft 33 and the shutter shaft 85. The conveyer shaft 90 is arranged in a lower position with respect to the shutter shaft 85. The gear shaft 60, the shutter shaft 85, and the conveyer shaft 90 are arranged to extend from the right-side face 51A of the holder 51 along the widthwise direction of the holder 51. The gear shaft 60, the shutter shaft 85, and the conveyer shaft 90 are attached to the holder 51 to rotatably support the idle gear 61, the shutter gear 84 and the one-way clutch 80, and the pickup roller 92 respectively.

The holder 51 further includes contact sections 52, 53 in upper positions on the right-side face 51A. The contact section 52 is arranged in a downstream position, and the contact section 53 is arranged in an upstream position along the sheet conveying direction on the right-side face 51A of the holder 51. The contact sections 52, 53 are pieces of flat plates protruding rightward from the right-side face 51A.

The separator roller 54 is arranged on the rotation shaft 33, which is rotated by driving force from the motor in the normal direction. In other words, when the motor is active, the rotation shaft 33 rotates in the counterclockwise direction in FIG. 5, and the separator roller 54 rotates in the counterclockwise direction along with the rotation shaft 33. Meanwhile, on the bottom of the original sheet tray 12, a separator pad 12A is arranged in a position to face the separator roller 54. The separator pad 12A and the separator roller 54 are made of a frictional material such as, for example, rubber. When the original sheet 101 (see FIG. 6) enters an intermediate position between the separator pad 12A and the separator roller 54, and when the separator pad 12A is urged by a circumferential surface of the separator roller 54, friction force is created in the intermediate position. Therefore, if a plurality of original sheets 100 enter the intermediate position, the separator roller 54 separates the topmost original sheet 101 from the remaining of the plurality of original sheets 100 at a nipped point between the separator roller 54 and the separator pad 12A by use of the friction, and solely the topmost original sheet 101 is forwarded in the conveyer path.

The torque limiter 57 is arranged on the rotation shaft 33 in a rightward position with respect to the right-side face 51A of the holder 51 to rotate along with the rotation of the rotation shaft 33. The torque limiter 57 is arranged with a roller gear 58, which is arranged coaxially with the torque limiter 57 and the rotation shaft 33. The torque limiter 57 absorbs and intercepts torque in a position between the rotation shaft 33 and the roller gear 58 when torque applied to the rotation shaft 33 exceeds predetermined intensity. In particular, when the separator roller 54 rotates in the reverse direction and torque to be applied to the separator roller 54 exceeds the predetermined intensity, the torque limiter 57 absorbs the torque.

The shutter gear 84 is rotatably arranged on the shutter shaft 85 in a rightward position with respect to the right-side face 51A of the holder 51 to rotate about the shutter shaft 85. The idle gear 61 is rotatably supported by the gear shaft 60 in a rightward position with respect to the right-side face 51A of the holder 51 to rotate about the gear shaft 60. The idle gear 61 is rotatably arranged in an intermediate position between the roller gear 58 and the shutter gear 84 and is engaged with the roller gear 58 and with the shutter gear 84.

The one-way clutch 80 is arranged on the shutter shaft 85, which protrudes rightward from the right-side surface 51A of the holder 51, in a rightward position with respect to the shutter gear 84. The one-way clutch 80 connects a roller gear system, which includes the roller gear 58, with a shutter 81 to establish a transmission path for the driving force. The one-way clutch 80 transmits the driving force from the roller gear 58 when the roller gear 58 rotates in the reverse direction and disconnects the transmission path when the roller gear 58 rotates in the normal direction.

The shutter 81 and a stopper 82 are arranged on a right-hand side of the shutter gear 84. In the present embodiment, the shutter 81, the stopper 82, and the one-way clutch 80 are formed integrally. The shutter 81 is formed in a shape of a flat plate extending from the one-way clutch 80 and is set in an orientation to extend toward the original sheet tray 12. The stopper 82 is formed to extend from the one-way clutch 80 and is set in an orientation to extend toward the upstream side along the sheet conveying direction (see FIG. 5). The shutter 81 and the stopper 82 are in positions at a right angle with respect to each other when viewed along an axial direction of the shutter shaft 85.

The shutter 81 is rotatable to move between a restrictive position (see FIG. 5), in which the shutter 81 is in the conveyer path to restrict the original sheet 101 from being carried to access the separator roller 54, and a retracted position (see FIG. 6), in which the shutter 81 is retracted in a position separated from a through-hole 12B. The through-hole 12B is formed in the bottom of the original sheet tray 12 in a position to coincide with shutter 81 in the restrictive position. When the shutter 81 is in the restrictive position, the shutter 81 restricts a position of the front ends, i.e., the most downstream ends along the sheet conveyer direction of the original sheets 100, which are to be carried to the separator roller 54.

The stopper 82 becomes in contact with the contact section 53, which is provided on the right-side face 51A of the holder 51, when the stopper 82 is rotated in the reverse direction (i.e., clockwise in FIG. 5) for a predetermined amount. Therefore, when the stopper 82 is in contact with the contact section 53, the stopper 82 is restricted from being rotated further in the reverse direction, and reverse rotation of the shutter 81 beyond the restrictive position is restricted.

The spring 70 is a resilient member, which is coiled around the gear shaft 60 (see FIG. 5). The spring 70 is rotatable with respect to the gear shaft 60 and has a first end 71 and a second end 72. The first end 71 and the second end 72 of the spring 70 are arranged at an obtuse angle with respect to each other when viewed along an axial direction of the gear shaft 60. The first end 71 is in contact with an outer plane, which is closer to the idle gear 61, of the shutter 81. The second end 72 is in contact with the contact section 52, which is formed on the right-side face 51A of the holder 51. Thus, with its resiliency, the spring 70 urges the shutter 81 toward the restrictive position in the conveyer path. In this regard, as mentioned above, the shutter 81 is restricted from being rotated further beyond the restrictive position due to the stopper 82 being in contact with the contact section 53. Therefore, by the urging force of the spring 70, when the original sheet tray 12 is empty and not containing any original sheet 100, the shutter 81 is placed in the restrictive position, in which the shutter 81 restricts entry of new original sheets 100. Thus, a next stack of original sheets 100 can be restricted from being forcibly or accidentally inserted in the conveyer path whilst the forcibly or accidentally inserted original sheets 100 may cause errors in sheet conveyance, such as multilayered feeding or idle feeding. According to the above configuration, however, the forcible or accidental insert of the new stack of original sheets 100 in the conveyer path may be prevented, and the erroneous sheet feeding can be effectively prevented. The resilience of the spring 70 is adjusted so that, when the topmost original sheet 101 is forwarded along the sheet conveying direction correctly by the feeder unit 50, the shutter 81 can be pushed by the original sheet 101 to rotate counterclockwise against the resiliency.

The pickup roller 92 being a feed roller is arranged to be rotatable along with the conveyer shaft 90, which is provided to the holder 51. The pickup roller 92 is rotatable in cooperation with the rotation shaft 33 via a transmission system (not shown). Therefore, when the rotation shaft 33 rotates, the pickup roller 92 rotates along with the separator roller 54 in the same direction. The pickup roller 92 picks up the topmost original sheet 101 from the stack of original sheets 100 being stacked in the original sheet tray 12 and feeds the topmost original sheet 101 to the separator roller 54.

Next, behaviors of the feeder unit 50 to feed and convey the original sheet 101 will be described hereinbelow with reference to FIGS. 5-9. In the present embodiment, the behaviors are classified in three stages, which are (A) restricting the entry of the original sheets 100, (B) conveying the original sheet 101, and (C) clearing sheet jam. In the following description, the counterclockwise direction in FIGS. 5-9 for the rollers and the shafts to rotate will be referred to as the normal direction, and the clockwise direction will be referred to as the reverse direction.

(A) Restricting Entry of the Original Sheets

When entry of the original sheets 100 in the area beyond the shutter 81 is restricted (see FIG. 5), the motor is inactive and motionless. When the motor is motionless, the rotation shaft 33 is not rotated. Therefore, the separator roller 54 and the pickup roller 92 are also maintained motionless. Further, no original sheet 101 is picked up from the stack of original sheets 100 in the original sheet tray 12. Without the rotation of the rotation shaft 33, the roller gear 58, the idle gear 61, and the shutter gear 84 (see FIG. 3) are maintained still. Furthermore, the shutter 81 attached to the one-way cutch 80 is not allowed to rotate counterclockwise further from the position shown in FIG. 5. In particular, the shutter 81 is placed in the restrictive position by the urging force of the spring 70. Therefore, when the motor is not in motion, the shutter 81 is maintained still in the restrictive position, and the position of the front ends of the original sheets 100 stacked in the original sheet tray 12 is restricted by the shutter 81. Thus, the original sheet 101 is restricted from being inserted in the conveyer path to access the separator roller 54.

(B) Conveying the Original Sheet

When the original sheet 101 is conveyed in the conveyer path, the motor is activated. When the motor is in motion, the driving gear 55 (see FIG. 3) rotates, and the rotation shaft 33 rotates in the normal direction (see FIG. 6). Further, the separator roller 54 rotates in the normal direction along with the rotation shaft 33, and the torque limiter 57 arranged on the rotation shaft 33 rotates in the normal direction. Accordingly, the roller gear 58 attached to the torque limiter 57 rotates in the normal direction, and the idle gear 61 engaged with the roller gear 58 rotates in the reverse direction. Further, the shutter gear 84 engaged with the idle gear 61 rotates in the normal direction, and the shutter shaft 85 rotates in the normal direction along with the shutter gear 84. In this regard, when the roller gear 58 rotates in the normal direction, the one-way clutch 80 disconnects the transmission path between the roller gear system including the roller gear 58 and the shutter 81. In other words, the one-way clutch 80 does not transmit the driving force from the motor to the shutter 81.

Meanwhile, the pickup roller 92 rotates in the normal direction in cooperation with the separator roller 54. Accordingly, the topmost original sheet 101 is picked up from the stack of original sheets 100 by the pickup roller 92 and forwarded to the separator roller 54. In this regard, due to the adjusted resiliency of the spring 70, the shutter 81 being disconnected from the driving force is pushed against the urging force of the spring 70 by the topmost original sheet 101 to rotate counterclockwise. Thus, the original sheet 101 is allowed to be forwarded to the separator roller 54. In the meantime, the separator roller 54 being urged against the separator pad 12A rotates in the normal direction, and the original sheet 101 being forwarded is allowed to access the intermediate position between the separator roller 54 and the separator pad 12A. Thus, at the nipped point between the separator roller 54 and the separator pad 12A, the topmost original sheet 101 is separated from the remaining of the plurality of original sheets 100 and forwarded in the conveyer path. As the original sheet 101 is conveyed in the conveyer path, the original image appearing on the surface of the original sheet 101 is read by the image sensor. Thereafter, the original sheet 101 with the original image having been read is discharged in the discharge tray 14.

In the present embodiment, a peripheral velocity of the shutter 81 is set to be greater than a peripheral velocity of the pickup roller 92. Therefore, when the pickup roller 92 picks up the original sheet 101, the one-way clutch 80 can promptly disconnect the shutter 81 from the roller gear 58, the idle gear 61, and the shutter gear 84. With the transmission path between the shutter 81 and the roller gear 58 disconnected, the original sheet 101 forwarded by the pickup roller 92 pushes the shutter 81 to rotate counterclockwise, and the original sheet 101 is conveyed smoothly by the separator roller 54. According to the present embodiment, the peripheral velocities of the pickup roller 92 and the shutter 81 are determined based on design values including rotation diameters of the gears and the pickup roller 92. Therefore, by adjusting these design values of the components, the peripheral velocity of the shutter 81 can be set to be greater than the peripheral velocity of the pickup roller 92.

(C) Clearing Sheet Jam

Sheet jam may occur when the motor is active and the original sheet 101 being conveyed by the feeder unit 50 is stuck in the conveyer path. When the sheet jam occurs, it is required that the motor is stopped and the user removes the jammed original sheet 101 out of the conveyer path in order to clear the sheet jam. In order to remove the jammed original sheet 101 and clear the sheet jam, in the present embodiment, the user is required to pull the jammed original sheet 101 backward, i.e., toward the original sheet tray 12.

When the sheet jam occurs, movements of the ADF 10 are stopped, and the motor is inactivated. The jammed original sheet 101 may be found in the intermediate position between the separator roller 54 and the separator pad 12A (see FIG. 7). The user is required to remove the stack of original sheets 100 from the original sheet tray 12 if any and withdraw the jammed original sheet 101 from a side of the original sheet tray 12 toward the upstream side along the sheet conveying direction. In this regard, a torque limiter 65 on the leftward position with respect to the driving gear 55 on the rotation shaft 33 is activated (see FIG. 4), and the transmission path between the motor and the separator roller 54 is disconnected. Therefore, the separator roller 54 released from the transmission path becomes rotatable to be rotated by the original sheet 101 being withdrawn. In other words, the original sheet 101 can be withdrawn easily. However, the transmission path between the motor and the separator roller 54 may not necessarily be disconnected by the torque limiter 65. For example, when the sheet jam is detected, the motor may be rotated in a reverse direction, and a planet gear arranged in an intermediate position between the motor and the driving gear 55 may be retracted. For another example, the torque limiter 65 may not necessarily be arranged on the above-mentioned position but may be arranged in any intermediate position between the roller gear 58 and the driving gear 55. In the present embodiment, a limit value for the torque limiter 65 is smaller than a limit value of the torque limiter 57.

Figure 7:
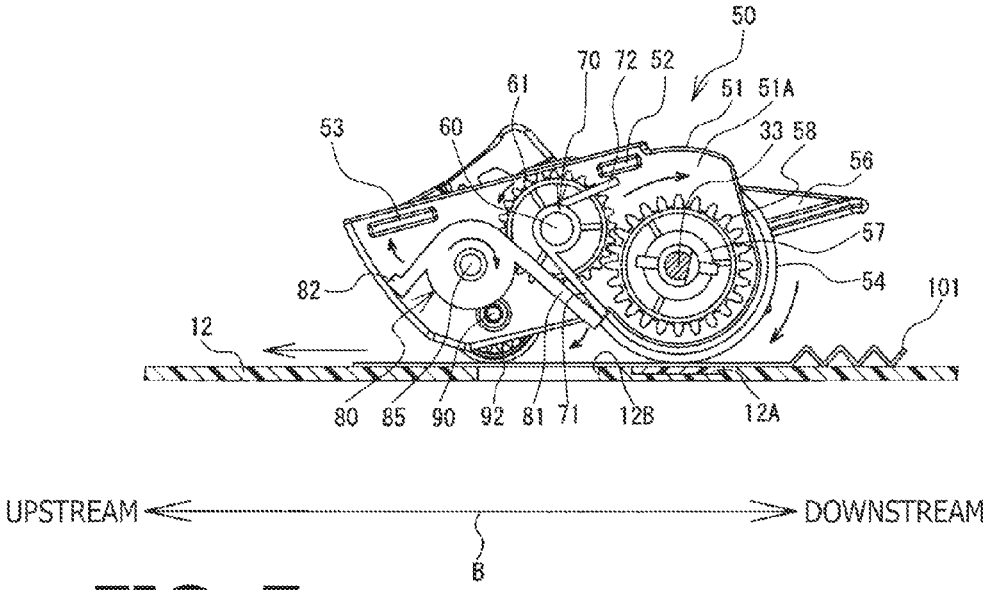
FIG. 7 is a side view of the feeder unit 50 in the MFP 1 when a jammed original sheet 101 is pulled backward.

Thus, with the torque limiter 57, when the original sheet 101 is withdrawn toward the upstream side along the conveyer path, the separator roller 54 being in contact with the original sheet 101 is rotated in the reverse direction (see FIG. 7). Accordingly, the rotation shaft 33 is also rotated in the reverse direction, and the torque limiter 57 arranged on the rotation shaft 33 is rotated in the reverse direction. Further, the roller gear 58 attached to the torque limiter 57 is rotated in the reverse direction, and the idle gear 61 engaged with the roller gear 58 is rotated in the normal direction. Furthermore, the shutter gear 84 engaged with the idle gear 61 is rotated in the reverse direction. When the shutter gear 84 rotates in the reverse direction, the shutter shaft 85 rotates in the reverse direction.

As mentioned above, the one-way clutch 80 connects the roller gear system, including the roller gear 58, with the shutter 81. The one-way clutch 80 transmits the driving force from the roller gear 58 when the roller gear 58 rotates in the reverse direction and disconnects the transmission path when the roller gear 58 rotates in the normal direction. Therefore, along with the reverse rotation of the shutter shaft 85, the shutter 81 rotates in the reverse direction, and an open edge of the shutter 81 becomes in contact with a top surface of the original sheet 101 (see FIG. 8). In this regard, by an effect of repelling force from the original sheet 101 to the shutter 81, the holder 51 is lifted upward. Further, the stopper 82 becomes in contact with the contact section 53 of the holder 51, and the reverse rotation of the shutter 81 is restricted thereat. When the reverse rotation of the shutter 81 is restricted, further rotations of the shutter gear 84, the idle gear 61, the roller gear 58, and the rotation shaft 33 are restricted.

Under this condition, however, as the original sheet 101 is continuously withdrawn, the separator roller 54 tends to rotate further in the reverse direction. However, the stopper 82 being in contact with the contact section 53 of the holder 51 tends to uplift the contact section 53 by use of the torque in the reverse direction (see FIG. 8). Accordingly, the holder 51 is uplifted and is rotated upward to swing about the rotation shaft 33. In this regard, the edge of the shutter 81 is separated from the top surface of the original sheet 101 being withdrawn; therefore, the original sheet 101 can be prevented from being damaged by the edge of the shutter 81. When the holder 51 is lifted further upward, the top plane of the holder 51 comes in contact with a holder restrictive piece 32A (see FIG. 2), which is formed on a downward surface of the top cover 32. Thus, the holder 51 is stopped thereat, which is a top dead center.

If the user attempts to pull the original sheet 101 further backward, however, the holder 51 cannot be rotated further. Therefore, intensive torque in a reverse direction is generated in the separator roller 54, and the generated torque is transmitted to the torque limiter 57. When intensity of the torque applied to the torque limiter 57 exceeds the predetermined intensity, the torque limiter 57 absorbs the torque and disconnects the transmission between the separator roller 54 and the roller gear 58. Therefore, the separator roller 54 and the rotation shaft 33 rotate idle. Thus, with the holder 51 maintained at the top dead center, the separator roller 54 is rotated in the reverse direction by the original sheet 101 being withdrawn. In other words, whilst the shutter 81 is maintained separated from the original sheet 101, the separator roller 54 is continuously allowed to rotate in the reverse direction. Accordingly, the sheet jam can be cleared without damaging the original sheet 101 by the shutter 81.

According to the present embodiment, a quantity of teeth in the shutter gear 84 is greater than a quantity of teeth of the roller gear 58. Therefore, the peripheral velocity of the separator roller 54 is greater than the peripheral velocity of the shutter 81, and the torque to be applied to the torque limiter 57 is lessened to be smaller than the torque generated in the separator roller 54. Accordingly, the jammed original sheet 101 can be withdrawn out of the conveyer path in smaller withdrawal force.

Further, it is preferable that the torque limiter 57 is designed to disconnect the transmission path when the holder 51 is rotated upward and the shutter 81 is separated from the original sheet 101. Therefore, the threshold intensity, at which the torque limiter 57 disconnects the transmission path, is adjusted in consideration of the behaviors of the relevant components including the holder 51, the shutter 81, and the separator roller 54.

According to the present embodiment, the roller gear system refers to the components, which are movable in cooperation of the separator roller 54 being driven, including, but not limited to, the driving gear 55 and the roller gear 58. If, for example, additional gears are provided in between the motor and the driving gear 55, the roller gear system should include those additional gears.

According to the present embodiment, a gear train, which can connect the roller gear system and the shutter 81 being a part of the one-way clutch 80 to transmit the torque, may be referred to as a shutter gear system. The shutter gear system may include, but not limited to, the idle gear 61 and the shutter gear 84. If, for example, additional gears are provided in between the roller gear system and the shutter 81, the shutter gear system should include those additional gears.

As has been described above, the MFP 1 according to the present embodiment includes the image reading apparatus 20, which includes the ADF 10, and the ADF 10 includes the feeder unit 50. Further, the feeder unit 50 includes the holder 51, which is rotatable about the rotation shaft 33. The holder 51 includes the separator roller 54, the torque limiter 57, the roller gear 58, the idle gear 61, the shutter gear 84, the one-way clutch 80, the spring 70, and the pickup roller 92.

When the motor is not in motion and the rotation shaft 33 is maintained still, the separator roller 54, the pickup roller 92, the roller gear 58, the idle gear 61, and the shutter gear 84 are motionless. In this regard, the shutter 81 in the one-way clutch 80 is maintained still at the restrictive position. Therefore, the position of the front ends of the original sheets 100 stacked in the original sheet tray 12 is restricted by the shutter 81, and entry of the stack of original sheets 100 to access the separator roller 54 is restricted.

When the motor is in active and the rotation shaft 33 rotates in the normal direction, the separator roller 54 and the roller gear 58 rotate in the normal direction. In this regard, the idle gear 61 engaged with the roller gear 58 rotates in the reverse direction, and the shutter gear 84 engaged with the idle gear 61 rotates in the normal direction. Accordingly, the shutter shaft 85 rotates in the normal direction along with the shutter gear 84. In this regard, the one-way clutch 80 absorbs the driving force from the motor, and the driving force is not transmitted to the shutter 81. Meanwhile, the pickup roller 92 rotates in the normal direction to forward the original sheet 101 to the separator roller 54. Accordingly, the shutter 81 is urged by the original sheet 101 to move toward the separator roller 54, and the conveyer path is open to the original sheet 101, Thus, the topmost original sheet 101 reaching the separator roller is separated from the lower original sheets 100 and forwarded further in the conveyer path.

When clearing the sheet jam, the user is required to pull the jammed original sheet 101 toward the side of the original sheet tray 12. Along with the original sheet 12 being withdrawn, the separator roller 54 rotates in the reverse direction. Further, the rotation shaft 33, the roller gear 58, the idle gear 61, the shutter gear 84, and the shutter shaft 85 rotate. In this regard, the torque in the reverse direction is applied to the one-way clutch 80 and is transmitted to the shutter 81. Thus, the shutter 81 rotates in the reverse direction. Accordingly, the stopper 82 is uplifted to be in contact with the contact section 53 of the holder 51, and the shutter 81 is restricted from being rotated further. As the original sheet 101 is withdrawn further, the stopper 82 tends to uplift the holder 51 at the contact section 53, and the holder 51 is rotated upwardly about the rotation shaft 33. In the meantime, the shutter 81 is separated and retracted from the upper surface of the original sheet 101. Therefore, the shutter 81 does not interfere with the original sheet 101 being withdrawn. In other words, the original sheet 101 is prevented from being interfered with or damaged by the shutter 81.

When the holder 51 rotates further upward, the holder 51 comes in contact with the holder restrictive piece 32A on the downward surface of the top cover 32 and is restricted from being rotated furthermore beyond the holder restrictive piece 32A. Therefore, the intense torque is generated in the separator roller 54 and transmitted to the torque limiter 57. When the intensity of the torque transmitted to the torque limiter 57 exceeds the predetermined intensity, the torque limiter 57 absorbs the torque to disconnect the transmission path between the separator roller 54 and the roller gear 58. Therefore, with the holder 51 maintained at the top dead center, the separator roller 54 is rotated in the reverse direction by the original sheet 101 being withdrawn. In other words, whilst the shutter 81 is maintained separated from the original sheet 101, the separator roller 54 is continuously allowed to rotate in the reverse direction. Accordingly, the sheet jam can be cleared without damaging the original sheet 101 by the shutter 81.

It is to be noted that embodiments of the disclosure are not limited to the example described above, but there may be numerous variations of the sheet conveyer device, the image reading apparatus, and the image forming apparatus. For example, the original sheets 100 to be conveyed in the feeder unit 50 may not necessarily be made of paper but may be made of resin or other materials which are formed in sheets.

Figure 4:
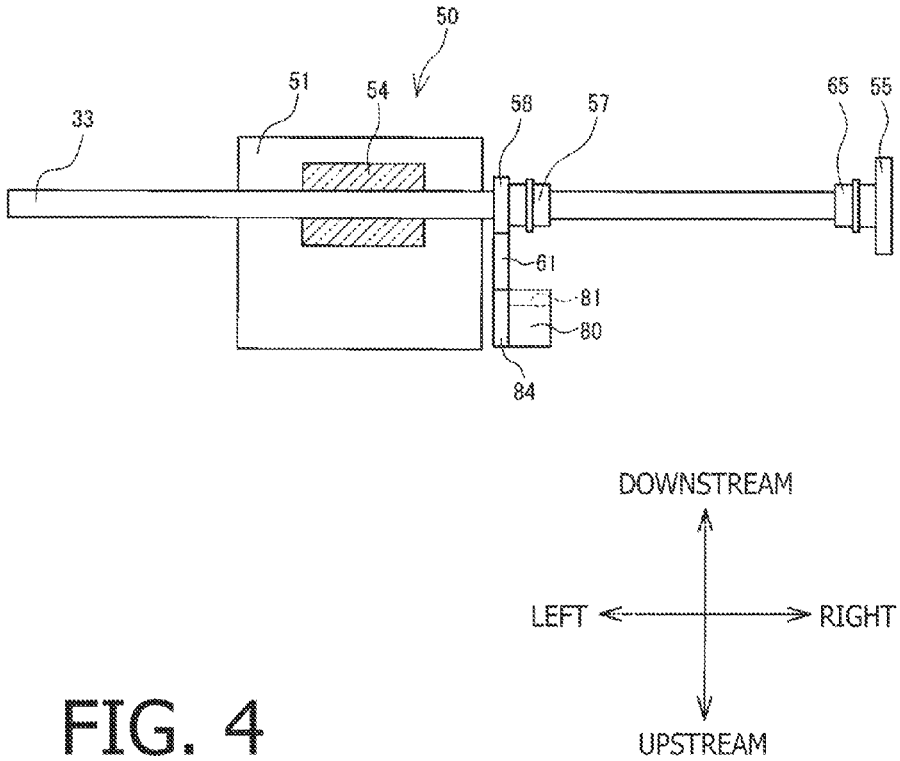
FIG. 4 is a top plane view of an upper part of the feeder unit 50 in the MFP 1.

For another example, the holder 51, the separator roller 54, the torque limiter 57, the roller gear 58, the idle gear 61, the shutter gear 84, and the one-way clutch 80 in the feeder unit 50 may not necessarily be arranged as illustrated in FIGS. 3-5. For example, the torque limiter 57 and the one-way clutch 80 in the holder 51 may not necessarily be disposed in the positions closer to the roller gear 58 and closer to the shutter gear 84 respectively. The torque limiter 57 may be disposed in the position closer to the shutter gear 84, and the one-way clutch 80 may be disposed in the position closer to the roller gear 58.

Next, therefore, feeder units 501, 502, in which the components are disposed in varied arrangement, will be described hereinbelow. The feeder units 501, 502 are variations of the feeder unit 50. Therefore, in the following description, the components which are common between the feeder unit 50 and the feeder units 501, 502 will be referred to by the same numeral signs, and description of those will be omitted.

The feeder unit 501 will be described with reference to FIG. 10. The feeder unit 501 includes the holder 51, the separator 54, a torque limiter 571, the roller gear 58, the idle gear 61, the shutter gear 84, a one-way clutch 801, and the torque limiter 65. Among these, the holder 51, the separator roller 54, the roller gear 58, the idle gear 61, and the torque limiter 65 are in the arrangement similar to that in the feeder unit 50 of the first embodiment. The roller gear 58 is arranged on the rotation shaft 33. Meanwhile, the one-way clutch 801 is attached on a right-side face of the idle gear 61. Further, the shutter gear 841 is attached to the one-way clutch 801. On a rotation shaft (not shown) of the shutter gear 841, the torque limiter 571 is attached. Furthermore, the shutter 810 is attached to the torque limiter 571. The shutter 810 may be formed integrally with the torque limiter 571.

In the feeder unit 501, the one-way clutch 801 is arranged in the position closer to the roller gear 58 than the one-way clutch 80 in the feeder unit 50. On the other hand, the torque limiter 571 is arranged in the position closer to the shutter gear 841 than the torque limiter 57 in the feeder unit 50. With the components arranged as described above, the feeder unit 501 can behave equivalently to the feeder unit 50 described in the first embodiment.

The feeder unit 502 will be described with reference to FIG. 11. The feeder unit 501 includes the holder 51, the separator 54, a torque limiter 572, the roller gear 58, the idle gear 61, the shutter gear 84, a one-way clutch 802, and the torque limiter 65. Among these, the holder 51, the separator roller 54, the roller gear 58, the idle gear 61, and the torque limiter 65 are in the arrangement similar to that in the feeder unit 50 and the feeder unit 501. The one-way clutch 802 is arranged on the rotation shaft 33. Further, the torque limiter 572 is arranged on a left-hand side of the one-way clutch 80 on the rotation shaft 33. The torque limiter 572 is connected with the roller gear 58 similarly to the torque limiter 57 in the feeder unit 50 of the first embodiment.

According to the arrangement in the feeder unit 502, the one-way clutch 802 as well as the torque limiter 572 is arranged in the position closer to the roller gear 58 than the one-way clutch 80 in the feeder unit 50 of the first embodiment. With the components arranged as described above, the feeder unit 502 can behave equivalently to the feeder unit 50 described in the first embodiment.

Although examples of carrying out the disclosure have been described, those skilled in the art will appreciate that there are numerous variations and permutations of the sheet conveyer device, the image reading apparatus, and the image forming apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, as has been described above, the arrangement of the torque limiter and the one-way clutch may be arbitrarily modified. However, it may be preferable that the torque limiter is arranged in an upstream position with respect to the shutter gear along the sheet conveying direction. When the torque limiter is arranged in the upstream position with respect to the shutter gear, the torque to be input in the torque limiter can be lessened. The lessened torque may allow the original sheet 101 to be withdrawn out of the conveyer path more easily.

For another example, the roller to be rotated by the original sheet 101 being withdrawn to move the shutter 81 in the retracted position may not necessarily be the separator roller 54 but may be replaced with another roller in the feeder units 50, 501, 502.

For another example, the position of the shutter 81 may not necessarily be limited, but the shutter 81 may be arranged in a center of the width of the feeder unit 50 (501, 502), which extends orthogonally to the sheet conveying direction. When the shutter 81 is in the widthwise central position, the position of the front end of the original sheet 101 may be restricted in a preferable balance with respect to the sheet conveying direction.

For another example, in the above-described embodiment, the one-way clutch 80 (801, 802) is formed integrally with the shutter 81; however, the one-way clutch 80 and the shutter 81 may be formed separately.

Further, the one-way clutch 80 (801, 802) may not necessarily be arranged on the shutter shaft 85 but may be arranged on a different shaft.

For another example, the holder restrictive piece 32A provided on the downward surface of top cover 32 to restrict the rotation of the holder 51 may not necessarily be essential but may be omitted. Further, the spring 70 may be omitted.

For another example, the spring 70 being a resilient member may not necessarily be the coiled spring but may be, for example, a blade spring as long as it provides resiliency to urge the shutter 81 in one direction.

For another example, the feeder unit 50 (501, 502) may not necessarily be arranged in the upper position with respect to the sheet conveyer path to contact the upper surface of the original sheet 101 by use of weight of the feeder unit 50 (501, 502) but may be arranged in the lower position with respect to the sheet conveyer path to be urged against the lower surface of the original sheet 101.

For another example, the holder restrictive piece 32A (see FIGS. 2, 9) may be replaced with another component in the feeder unit 50 (501, 502). For example, the shaft 41A of the conveyer roller 41 may serve to restrict the upward rotation of the holder 51, and the extended section 56 in the holder 51 may be in contact with the shaft 41A to restrict the holder 51.

For another example, the contact section 53 may not necessarily be uplifted by the stopper 82 in the one-way clutch 50 but may be urged upwardly by another stopper member arranged on the shutter shaft 85.

What is claimed is:

1. A sheet conveyer device, which is configured to convey a sheet in a conveyer path along a conveying direction, comprising:

a roller, which is rotatably arranged on a roller shaft to rotate about the roller shaft and is configured to convey the sheet by rotating in a normal direction;

a holder, which is rotatably arranged on the roller shaft to rotate about the roller shaft, wherein the holder comprises:

a roller gear system, which is arranged on the roller shaft and includes a roller driving gear to drive the roller and a roller gear arranged on the roller shaft;

a shutter, which is rotatably arranged on a shutter shaft and is configured to restrict access of the sheet to the roller, the shutter shaft being arranged in an upstream position with respect to the roller shaft along the conveying direction;

a shutter gear system, which is arranged to be movable in cooperation with the shutter shaft and is configured to connect a path between the roller gear system and the shutter, wherein the shutter gear system includes a shutter gear arranged on the shutter shaft, a quantity of gear teeth in the shutter gear being greater than a quantity of gear teeth in the roller gear;

a one-way clutch, which is arranged in the roller gear system or the shutter gear system and is configured to disconnect the path between the roller gear system and the shutter when the roller rotates in the normal direction; and a torque limiter, which is arranged on the roller gear of the roller gear system and is configured to allow the roller to rotate in a reverse direction, the reverse direction being an opposite direction from the normal direction; and a shutter restrictive member, which is configured to restrict rotation of the shutter when the roller rotates in the reverse direction, wherein the holder is configured to rotate about the roller shaft in the same reverse direction as the roller when the roller rotates in the reverse direction.

2. The sheet conveyer device according to claim 1, further comprising:

a holder restrictive member, which is configured to restrict rotation of the holder.

3. The sheet conveyer device according to claim 1, further comprising:

a resilient member, which is configured to urge the shutter toward the conveyer path.

4. The sheet conveyer device according to claim 1, wherein the roller is a separator roller, which is configured to convey the sheet separately from another sheet.

5. A sheet conveyer device, which is configured to convey a sheet in a conveyer path along a conveying direction, comprising:

a roller, which is rotatably arranged on a roller shaft to rotate about the roller shaft and is configured to convey the sheet by rotating in a normal direction; and a holder, which is rotatably arranged on the roller shaft to rotate about the roller shaft, wherein the holder comprises:

a roller gear system, which is arranged on the roller shaft and has a roller driving gear to drive the roller;

a shutter, which is rotatably arranged on a shutter shaft and is configured to restrict access of the sheet to the roller, the shutter shaft being arranged in an upstream position with respect to the roller shaft along the conveying direction;

a shutter gear system, which is arranged to be movable in cooperation with the shutter shaft and is configured to connect a path between the roller gear system and the shutter;

a one-way clutch, which is arranged in the roller gear system or the shutter gear system and is configured to disconnect the path between the roller gear system and the shutter when the roller rotates in the normal direction; and a torque limiter, which is arranged in the roller gear system or the shutter gear system and is configured to allow the roller to rotate in a reverse direction, the reverse direction being an opposite direction from the normal direction; and a feeder roller, which is arranged in an upstream position with respect to the roller along the conveying direction and is configured to feed and convey the sheet toward the roller, wherein the holder is configured to rotate about the roller shaft in the same reverse direction as the roller when the roller rotates in the reverse direction, and wherein a peripheral velocity of the shutter is greater than a peripheral velocity of the feeder roller.

6. The sheet conveyer device according to claim 1, further comprising an image reading unit configured to read an image on the sheet conveyed by the sheet conveyer device.

7. The sheet conveyer device according to claim 6, further comprising an image forming unit configured to form an image on a recording medium according to the image read by the image reading unit.

8. The sheet conveyer device according to claim 5, further comprising an image reading unit configured to read an image on the sheet conveyed by the sheet conveyer device.

9. The sheet conveyer device according to claim 8, further comprising an image forming unit configured to form an image on a recording medium according to the image read by the image reading unit.

* * * * *